US005661933A

United States Patent [19]

DeJonghe

[11] Patent Number: 5,661,933

[45] Date of Patent: Sep. 2, 1997

[54] LOCKABLE GROUND ANCHOR FOR SPORTS EQUIPMENT

[76] Inventor: Leslie A. DeJonghe, 7488 Ridge Hwy., Britton, Mich. 49229

[21] Appl. No.: 561,841

[22] Filed: Nov. 22, 1995

[51] Int. Cl.[6] ..... E02D 5/74

[52] U.S. Cl. ..... 52/166; 52/155; 52/156; 52/153; 52/154; 405/244

[58] Field of Search ..... 135/118; 52/155, 52/156, 160, 153, 154, 162, 166, 158; 405/244; 114/299; 294/107

[56] References Cited

U.S. PATENT DOCUMENTS

| | | | |
|---|---|---|---|
| 828,509 | 8/1906 | Rounsburg | 135/118 X |
| 1,031,270 | 6/1912 | Jones | 294/107 |
| 2,639,937 | 5/1953 | Billings | 294/107 X |
| 3,193,319 | 7/1965 | Frock et al. | 294/107 X |
| 3,803,783 | 4/1974 | Ballew | 52/162 X |
| 5,078,214 | 1/1992 | Holley | 294/107 X |

*Primary Examiner*—Wynn E. Wood
*Assistant Examiner*—Timothy B. Kang
*Attorney, Agent, or Firm*—Howard & Howard

[57] ABSTRACT

An anchor apparatus for anchoring an article to the ground includes a pair of spaced apart legs rotatably mounted on an axle. Each of the legs has a curved tine attached thereto for insertion into the ground as the legs are rotated in opposite directions about the axle. A lug on each leg receives a pin in an aperture for preventing rotation of the legs relative to one another and the tines have flanges which resist pulling the tines from the ground. A chain is connected between one end of the pin and a sleeve. When the tines are inserted into the ground, the pin is inserted into the apertures in the lugs and the sleeve is positioned on the pin between the lugs, the chain can be looped around a portion of a sports goal frame resting on the ground and a lock can be inserted through the chain and an aperture in one of the lugs such that the anchor apparatus prevents the sports goal from tipping over.

15 Claims, 2 Drawing Sheets

LOCKABLE GROUND ANCHOR FOR SPORTS EQUIPMENT

BACKGROUND OF THE INVENTION

The present invention relates generally to an apparatus for anchoring devices to the ground and, in particular, to an apparatus for lockably anchoring sports goals.

Many devices exist for anchoring an article to the ground. For example, the U.S. Pat. No. 210,283 shows a vertically extending fence post which is driven into the ground. A pair of curved angular braces are rotatably mounted on the fence post and are driven into the ground along circular arcuate paths.

The U.S. Pat. No. 4,315,387 shows a ground anchor stake device having an angular spike and an arcuate tine. The spike is pushed into the ground at an acute angle and the tine is then pushed into the ground in a circular arcuate path.

Typically, sports goals such as soccer goals are made with a net hung from a tubular frame. Such goals are meant to rest on the ground. However, without an anchor, there is the danger that a person climbing on the goal will tip it over hurting himself or a bystander. While existing anchors may be able to prevent tipping, they can easily be removed from the ground by reversing the installation procedure. Thus, there is a need for a ground engaging anchor which can be attached to a sports goal and locked in place to prevent unauthorized removal of the anchor.

SUMMARY OF THE INVENTION

The present invention concerns an anchor apparatus for anchoring an article, such as a soccer goal, to the ground. The anchor apparatus includes an axle means, a pair of leg members rotatably mounted in spaced apart relation on the axle means, each of the leg members having a ground engaging curved tine member thereon, and a lock means for releasably engaging the leg members whereby when the leg members are rotated about the axle means in opposite directions to drive the tine members into an area of ground and the lock means is subsequently engaged with the leg members, the leg members are prevented from rotation relative to one another about the axle means. The axle means has opposite ends and the leg members each have a tubular axle retainer thereon for receiving a corresponding one of the axle means ends. The axle means is elongated and tubular and each of the leg members has an aperture formed therein. A bolt extends through the apertures and the axle means and threadably engages a nut for retaining the leg members on the axle means.

The tine members each have a flange thereon, each flange extending outwardly from the tine in a curved plane. The tine members also each have a tab thereon for receiving a force to rotate the leg members about the axle means. The leg members each have a lug thereon with an aperture formed therein. A pin having a similar length to said axle means is inserted through the lug apertures to prevent relative rotation of the leg members about the axle means. The lugs each have a tubular pin retainer thereon concentric with the aperture for receiving the pin. A sleeve is positioned between the pin retainers for receiving the pin and a chain is attached between the sleeve and the pin. At least one of the lugs has another aperture formed therein for receiving a shackle of a padlock which shackle also passes through a link of the chain.

It is an object of the present invention to provide a ground engaging anchor which is easy to install and remove.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
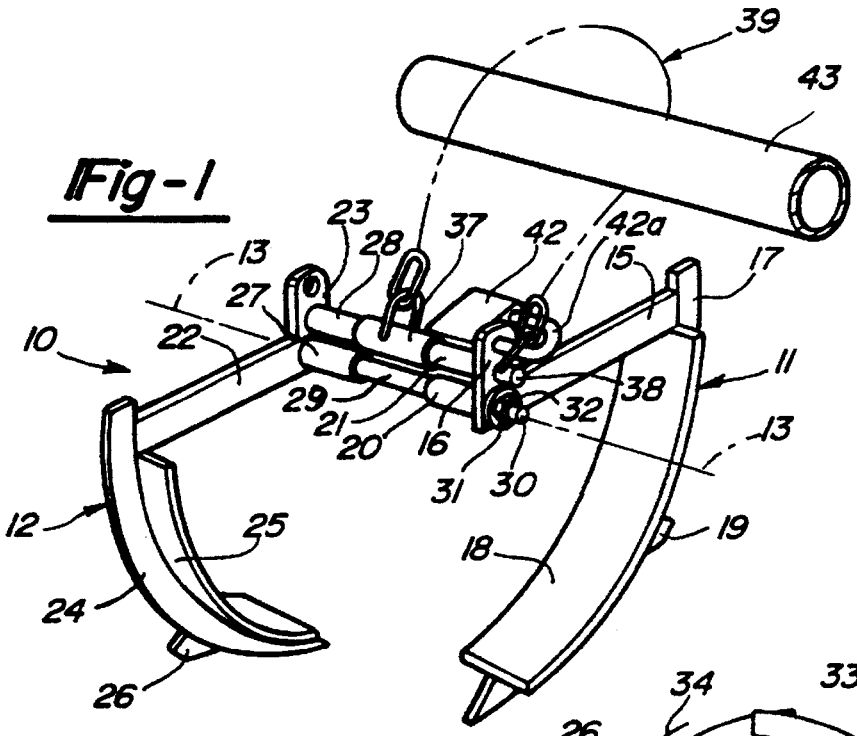
FIG. 1 is a perspective view of a lockable ground anchor apparatus in accordance with the present invention.

There is shown in the FIG. 1 through 5 a lockable ground anchor apparatus 10 which includes a first ground engaging leg member 11 and a second ground engaging leg member 12, which leg members are rotatable relative to one another about an axis of rotation 13 shown in the FIG. 1. In the FIG. 2, the anchor apparatus 10 is shown with the leg members 11 and 12 retracted to a first position prior to insertion into a portion of ground 14. In the FIG. 3, the leg members 11 and 12 are shown in a second position partially inserted into the ground 14. In the FIG. 4, the leg members 11 and 12 are shown fully inserted into the ground 14 for a maximum anchoring.

Figure 5:
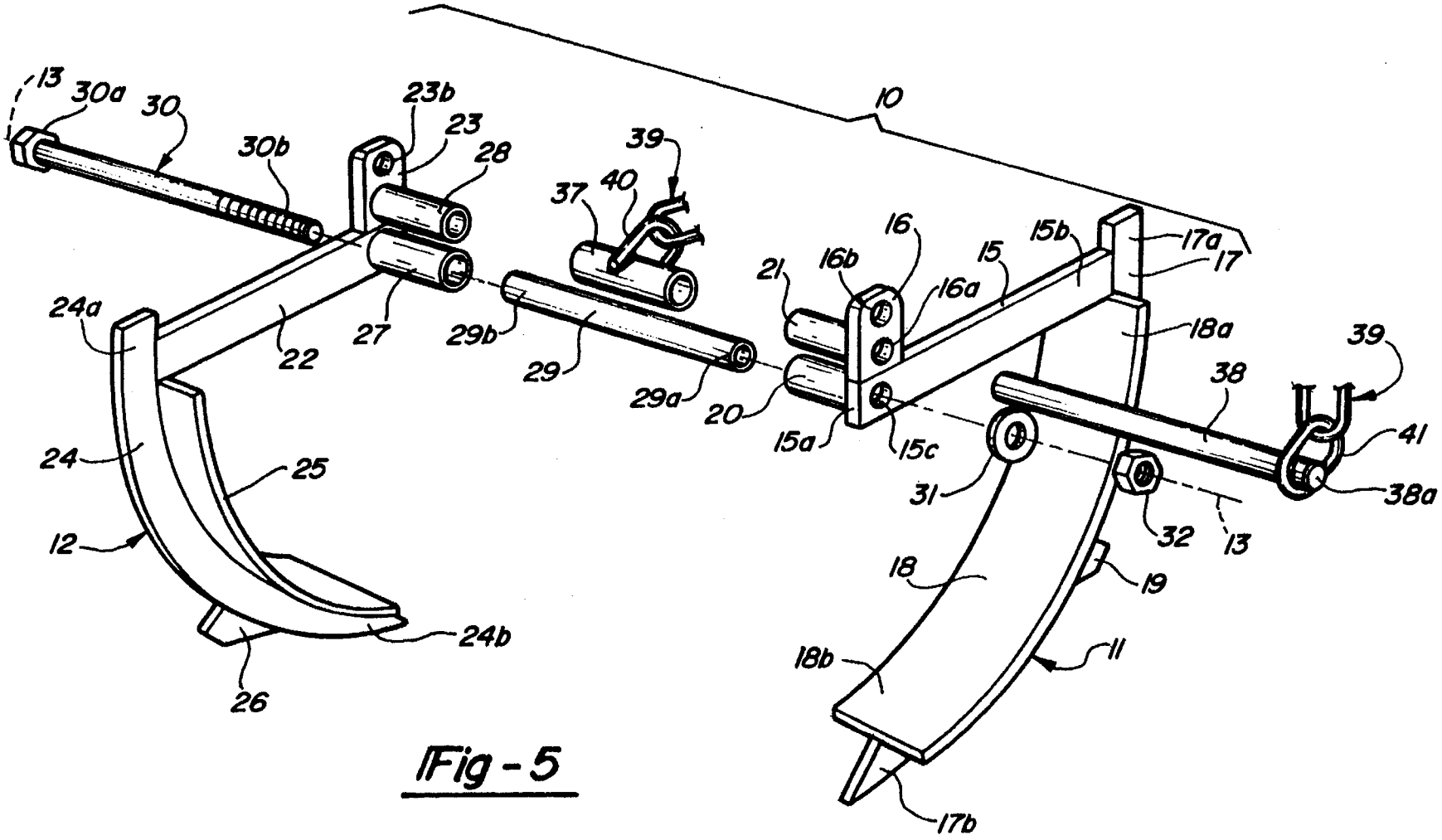
FIG. 5 is an enlarged exploded perspective view of the apparatus shown in the FIG. 1.

As more fully explained by reference to the FIG. 1 and the FIG. 5, the first leg member 11 includes a generally planar, horizontally elongated base member 15 extending in a generally vertical plane and having a first end 15*a* through which the axis of rotation 13 extends and a second or opposite end 15*b*. Attached to the first end 15*a* of the base member 15 is a lug 16 which extends upwardly at right angles to and in the same plane as the base member 15. The second end 15*b* of the base member 15 is attached to a first end 17*a* of an arcuate, generally planar tine member 17 which extends in the same plane as the base member. A second or opposite free end 17*b* of the tine member 17 is formed into a point. The tine member 17 extends downwardly from the first end 17*a* in a path at a fixed radius from the axis of rotation 13. An inner curved edge of the tine member 17 faces toward the axis of rotation 13 and has a curved flange member 18 attached thereto. The flange member 18 has a first end 18*a* abutting the second end 15*b* of the base member 15 and has a second or opposite end 18*b* adjacent the second end 17*b* of the tine member 17. The flange member 18 extends in a curved plane perpendicular to the plane in which the base member 15 and the tine member 17 extend. The width of the flange member 18 is substantially greater than the thickness of the tine member 17. An outer curved edge of the tine member 17 faces away from the axis of rotation 13 and has a tab 19 attached thereto. The tab 19 extends in the plane of the base member 15 and the tine member 17 and is located approximately midway between the first end 17*a* and the second end 17*b* of the tine member.

The first end 15*a* of the base member 15 has an aperture 15*c* formed therein. A tubular axle retainer 20 is attached to a planar surface of the base member 15 concentric with the aperture 15*c*. The lug 16 has a pair of apertures, a first aperture 16*a* and a second aperture 16*b*, formed therein. The apertures 16*a* and 16*b* are aligned vertically with the aperture 15*c* and the second aperture 16*b* is located above the first aperture 16*a*. A tubular pin retainer 21 is attached to a planar surface of the lug 16 concentric with the aperture 16*a* and extending generally parallel to and in the same direction as the axle retainer 20. The lug 16 and the tine member 17 are attached to the base member 15, the tab 19 and the flange 18 are attached to the tine member, the axle retainer 20 is attached to the base member and the pin retainer 21 is attached to the lug by any suitable means such as welding. Although the base member 15, the lug 16, the tine member 17 and the tab 19 are shown as separate parts, they could be formed as an integral unit from a single piece of metal by a process such as stamping. In the alternative, the base member 15, the lug 16, the line member 17, the flange 18 and the tab 19, and possibly the axle retainer 20 and the pin retainer 21, can be formed as an integral unit by any suitable process such as casting.

The leg member 12 is similar to the leg member 11 in construction and includes a base member 22, a lug 23, a tine member 24, a flange member 25, a tab 26, an axle retainer 27 and a pin retainer 28. The leg member 12 can be identical in shape and construction to the leg member 11 such that only one configuration of leg member need be manufactured.

The leg members 11 and 12 are rotatably mounted on opposite ends of a tubular axle 29. The axle 29 has an outer diameter smaller than an inner diameter of the axle retainers 20 and 27 and larger than a diameter of the aperture 15*c* in the base member 15 and the corresponding aperture (not shown) in the base member 22. Thus, a first end 29*a* of the axle 29 extends into the axle retainer 20 and bottoms against a facing surface of the first end 15*a* of the base member 15. Similarly, a second or opposite end 29*b* of the axle 29 extends into the axle retainer 27 and bottoms against a facing surface of the base member 22. The leg members 11 and 12 are rotatably retained on the axle 29 by a retainer means 30 in the form of a bolt having a head 30*a* at one end and a threaded portion 30*b* at an opposite end. The bolt 30 is inserted through the aperture (not shown) in the base member 22, the axle retainer 27, the axle 29, the axle retainer 20, the aperture 15*c* formed in the base member 15 and a lock washer 31. A nut 32 is threadably retained on the threaded end 30*b* and is rotated until the head 30*a* of the bolt abuts a facing surface of the base member 22 and the lock washer 31 abuts a facing surface of the base member 15. However, the force applied by the nut 32 and the lock washer 31 is not sufficient to prevent relative rotation of the leg members 11 and 12 on the axle 29.

Figure 2:
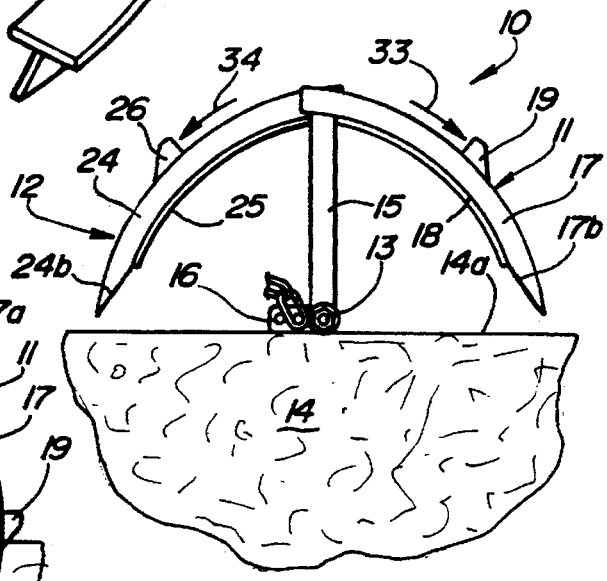
FIG. 2 is a from elevation view of the apparatus shown in the FIG. 1 before insertion into the ground.
Figure 4:
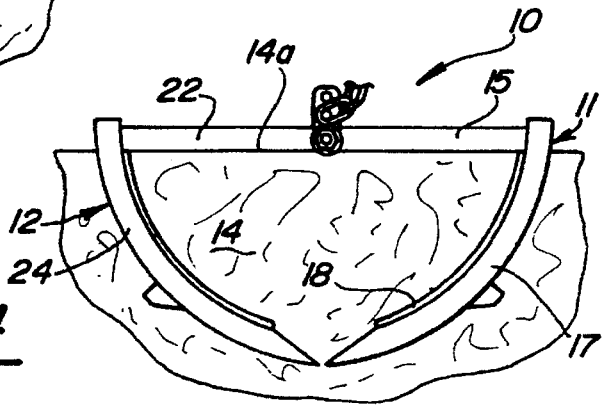
FIG. 4 is a view similar to the FIG. 2 with the apparatus fully inserted into the ground.

The steps involved in the installation of the lockable ground anchor apparatus 10 are shown in the FIG. 2 through the FIG. 4. In the FIG. 2, the anchor apparatus 10 is positioned on a surface 14*a* of the ground 14 with the lug 16 in a generally horizontal orientation and the base member 15 in a generally vertical orientation. The lug 23 (hidden) is aligned with the lug 16 and the base member 22 (hidden) is aligned with the base member 15. Accordingly, the second end 17*b* of the tine member 17 and a corresponding second end 24*b* of the tine member 24 are positioned above and adjacent to the ground surface 14*a*. In order to engage the tine members 17 and 24 with the ground 14, a force is applied to rotate the leg members 11 and 12 in opposite directions about the axis of rotation 13. A first force is applied in a direction of an arrow 33 to rotate the leg member 11 in a clockwise direction about the axis of rotation 13. Similarly, a second force is applied in a direction of an arrow 34 to rotate the leg member 12 about the axis of rotation 13 in a counterclockwise direction. Conveniently, the forces can be applied to the tabs 19 and 26 by any suitable means Such as striking them with a hammer or standing on them with a foot of a person.

Figure 3:
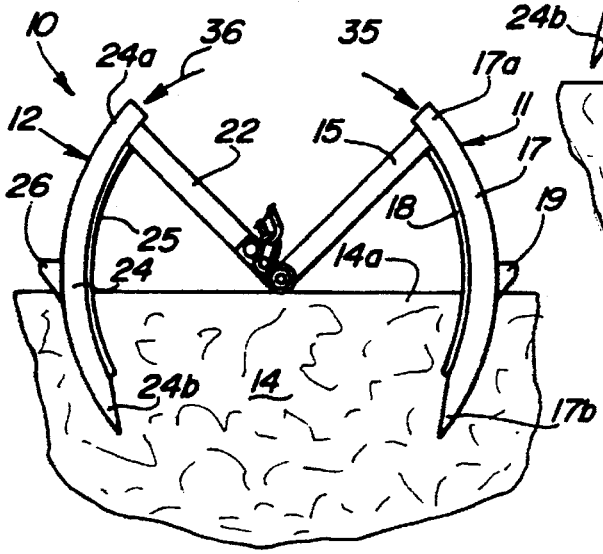
FIG. 3 is a view similar to the FIG. 2 with the apparatus partially inserted into the ground.

Each of the leg members 11 and 12 is rotated until the tabs 19 and 26 are abutting the surface 14*a* as shown in the FIG. 3. The pointed ends 17*b* and 24*b* have entered the ground 14 along with a portion of the tines 17 and 24 and a portion of the flanges 18 and 25. Now the forces can be applied in the direction of an arrow 35 to the first end 17*a* of the tine member 17 and in the direction of an arrow 36 to a first end 24*a* of the tine member 24. These forces are applied to rotate the leg members 11 and 12 in the clockwise and counterclockwise directions respectively until the base members 15 and 22 extend in a generally horizontal direction and abut the ground surface 14*a* as shown in the FIG. 4. The anchor assembly 10 is now firmly engaged with the ground 14 and requires the application of a considerable pulling force in order to pull the upwardly facing planar surfaces of the flanges 18 and 25 through that portion of the ground between them and the surface 14*a*.

In order to prevent the anchor assembly 10 from being easily removed from the installed position shown in the FIG. 4, a locking means is provided to prevent rotation of the leg members 11 and 12 back to the positions shown in the FIG. 2. The spacing between the facing surfaces of the lugs 16 and 23 is determined by the length of the axle 29. A sleeve 37 has a length equal to the length of the axle 29 minus the length of the pin retainers 21 and 28. A pin 38 is inserted through the aperture 16*a*, the pin retainer 21, the sleeve 37, the pin retainer 28 and an aperture (not shown) formed in the lug 23. The pin 38 prevents relative rotation of the leg members 11 and 12 with respect to one another about the axis of rotation 13. Thus, when the pin 38 is installed in the position shown in the FIG. 1, the leg members 11 and 12 cannot be rotated in opposite directions about the axis of rotation 13. A chain 39 has an open link 40 at one end attached to an outer surface of the sleeve 37 by any suitable means such as welding. The chain 39 has a closed link 41 at the opposite end thereof attached to an end 38*a* of the pin 38 by any suitable means such as welding. To prevent the pin 38 from being removed from the anchor assembly 10, a lock means 42, such as a padlock, can have a shackle 42*a* which can be passed through the closed link 41 and through the aperture 16*b*.

Not only does the chain 39 keep the sleeve 37 and the pin 38 from being separated when the anchor means 10 is disassembled, but the chain also provides a means for attaching the anchor assembly to a device to be anchored, such as a soccer goal. A frame of a soccer goal is typically formed of a tubular material. There is shown in the FIG. 1, a portion 43 of a soccer goal tubular frame which portion typically rests on the ground surface 14*a*. When the anchor assembly 10 is installed in the ground 14 in the position shown in the FIG. 4, the chain 39 can be looped about the frame member portion 43, as shown in the FIG. 1, prior to the installation of the lock means 42. If two of the anchor assemblies 10 are installed on opposite sides of the soccer goal, the soccer goal is prevented from being tipped over either accidentally or on purpose and injuring a person. When the soccer goal is to be removed from the field, the anchor assembly 10 can easily be unlocked and removed from the ground 14 by rotating the leg members 11 and 12 in counterclockwise and clockwise directions respectively to disengage the tine members 17 and 24 from the ground.

Obviously, the bolt 30 can be inserted with the head 30*a* abutting the base member 15 and the washer 31 and the nut 32 abutting the base member 32. Furthermore, the pin 38 can be inserted with the end 38*a* adjacent the lug 23 such that the shackle 42*a* of the lock 42 can extend through the closed link 41 and an aperture 23*b* formed in the lug 23.

The anchor assembly 10 also can be incorporated into the article to be anchored. For example, the head 30*a* of the bolt 30 can be attached to the outer surface of the frame portion 43 such that the anchor apparatus 10 is affixed to the goal frame. A spacer (not shown) would be required between the head 30*a* and the base member 22 to provide clearance for the flange member 25. Of course, the bolt 30 could also be inserted through an aperture (not shown) formed through be replaced by a threaded rod (not shown) attached to the frame portion. Also, the axle 29 can be eliminated if the axle retainers 20 and 27 are sized for the bolt 30 and lengthened to provide the desired spacing between the leg members 11 and 12.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An anchor apparatus for anchoring an article to the ground comprising:

an axle means, said axle means having a length;

a pair of leg members rotatably mounted in spaced apart relation on said axle means, each said leg member having a base member with a first end rotatably mounted on said axle means, an opposite end and a ground engaging curved tine member with a first end attached to said opposite end of said base member and an opposite free end, said leg members being free to rotate on said axle means independent of one another; and a lock means having a length substantially equal to said length of said axle means for releasably and simultaneously engaging both of said leg members thereby preventing rotation of said leg members relative to one another about said axle means while coupling said leg members to rotate about said axle means together whereby when said leg members are rotated about said axle means in opposite directions to move said opposite free ends of said tine members toward one another and to drive said tine members into an area of ground and said lock means is subsequently releasably engaged with said leg members, said base members are positionable above a surface of the area of ground and said leg members are prevented from rotation relative to one another about said axle means by said lock means to prevent rotation of said opposite free ends of said tine members away from one another.

2. The anchor apparatus according to claim 1 wherein said axle means has opposite ends and said leg members each have a tubular axle retainer thereon at said first end of said base member for receiving a corresponding one of said axle means ends.

3. The anchor apparatus according to claim 1 wherein said axle means is tubular and each of said base members has an aperture formed therein and including a bolt extending through said apertures and said axle means and threadably engaging a nut for retaining said leg members on said axle means.

4. The anchor apparatus according to claim 1 wherein said tine members each have a flange thereon, each said flange extending outwardly from said tine member in a curved plane.

5. The anchor apparatus according to claim 1 wherein said tine members each have a tab thereon for receiving a force to rotate said leg members about said axle means.

6. The anchor apparatus according to claim 1 wherein said leg members each have a lug thereon, said lugs each having an aperture formed therein, and including a pin for insertion through said apertures to prevent relative rotation of said leg members about said axle means.

7. The anchor apparatus according to claim 6 wherein said lugs each have a tubular pin retainer thereon, each said pin retainer being concentric with said aperture for receiving said pin.

8. The anchor apparatus according to claim 7 including a sleeve positioned between said pin retainers for receiving said pin and a chain attached between said sleeve and said pin.

9. The anchor apparatus according to claim 8 wherein at least one of said lugs has another aperture formed therein for receiving a shackle of a padlock which shackle also passes through a link of said chain.

10. An anchor apparatus for anchoring an article to the ground comprising: an axle means having opposite ends;

a pair of base members each having an axle retainer attached thereto, each said axle retainer receiving a corresponding one of said ends of said axle means for rotatably mounting said base members in spaced apart relation on said axle means;

a pair curved tine members, each said tine member being attached to a corresponding one of said base members;

a pair of lugs, each said lug being attached to one of said base members and having an aperture formed therein; and a pin for insertion through said apertures in said lugs whereby when said base members are rotated about said axle in opposite directions to drive said tine members into an area of ground and said pin is subsequently inserted into said apertures, said base members are prevented from rotation relative to one another about said axle means.

11. The anchor apparatus according to claim 10 wherein said axle means is tubular and each of said base members has an aperture formed therein and including a bolt extending through said base member apertures, said axle retainers and said axle means and threadably engaging a nut for retaining said leg members on said axle means.

12. The anchor apparatus according to claim 11 wherein said tine members each have a flange thereon, each said flange extending outwardly from said tine member in a curved plane, and each said tine member has a tab thereon for receiving a force to rotate said base members and said tine members about said axle means.

13. The anchor apparatus according to claim 11 wherein said lugs each have a tubular pin retainer thereon, each said pin retainer being concentric with said lug aperture for receiving said pin, and including a sleeve positioned between said pin retainers for receiving said pin and a chain attached between said sleeve and said pin.

14. The anchor apparatus according to claim 13 wherein at least one of said lugs has another aperture formed therein for receiving a shackle of a padlock which shackle also passes through a link of said chain.

15. An anchor apparatus for anchoring a sports goal to the ground comprising:

a tubular axle having opposite ends;

a pair of base members, each said base member having opposite ends with an aperture in one of said base member ends;

a pair of tubular axle retainers, each said axle retainer being attached to a corresponding one of said base members concentric with said base member aperture, each said axle retainer receiving a corresponding one of said axle ends for rotatably mounting said base members in spaced apart relation on said axle;

a bolt extending through said base member apertures, said axle retainers and said axle and threadably engaging a nut for retaining said base members on said axle;

a pair of curved tine members, each said tine member being attached to a corresponding one of said base members;

a pair of flange members, each said flange member being attached to a corresponding one of said tine members;

a pair of tabs, each said tab being attached to a corresponding one of said tine members;

a pair of lugs, each said lug being attached to a corresponding one of said base members and having a first aperture formed therein, at least one of said lugs having a second aperture formed therein;

a pair of tubular pin retainers, each said pin retainer being attached to a corresponding one of said lugs concentric with said first lug aperture;

a pin for insertion through said first lug apertures and said pin retainers to prevent relative rotation of said base members about said axle;

a sleeve;

a chain attached between said sleeve and said pin; and a lock means whereby when force is applied to said tabs to rotate said base members about said axle and insert said tine members into an area of ground, said chain is looped about a frame portion of a sports goal, said pin is inserted through said first lug apertures, said pin retainers and said sleeve positioned between said pin retainers and said lock means engages said chain and said second lug aperture, the sports goal is prevented from tipping over.

* * * * *